United States Patent [19]

Volkmar

[11] Patent Number: 4,642,594

[45] Date of Patent: Feb. 10, 1987

[54] U-SHAPED SOLID MAGNETIC CORE WITH AT LEAST ONE OPENING THROUGH THE MIDSECTION THEREOF

[75] Inventor: Ralf R. Volkmar, Berlin, Fed. Rep. of Germany

[73] Assignee: Siemens Energy & Automation, Inc., Atlanta, Ga.

[21] Appl. No.: 639,952

[22] Filed: Aug. 10, 1984

[51] Int. Cl.[4] ..... H01F 7/08

[52] U.S. Cl. ..... 335/227; 335/236; 335/281

[58] Field of Search ..... 335/236, 237, 227, 281

[56] References Cited

U.S. PATENT DOCUMENTS

| | | | |
|---|---|---|---|
| 2,144,546 | 1/1939 | Reese et al. | 335/236 X |
| 2,313,527 | 3/1943 | Edwards | 335/227 X |
| 2,476,419 | 7/1949 | Koenig | 335/236 X |
| 2,717,978 | 9/1955 | DeFligue | 335/281 |
| 2,952,801 | 9/1960 | Hyink | 335/281 X |
| 3,301,141 | 1/1967 | Griffing | 335/236 X |
| 3,571,769 | 3/1971 | Pegram | 335/227 X |

*Primary Examiner*—George Harris

*Attorney, Agent, or Firm*—F. W. Powers; J. L. James

[57] ABSTRACT

An actuating magnet is provided for a circuit interrupter. The magnet yoke is assembled from three solid segments of magnetic material to produce a U-shaped core. One or more coils are disposed on the core loop, and the center of the yoke is interrupted by a series of aligned holes.

7 Claims, 4 Drawing Figures

U-SHAPED SOLID MAGNETIC CORE WITH AT LEAST ONE OPENING THROUGH THE MIDSECTION THEREOF

BACKGROUND OF THE INVENTION

The present invention relates to a magnetic actuating system, and more particularly to an improved electromagnetic yoke for operating a circuit interrupting system.

Circuit protection apparatus, including circuit breakers and interrupters, may be actuated by pneumatic, hydraulic, mechanical or magnetic means. For circuit breakers, which operate to suddenly open an electrical circuit upon sensing of an overload, often a spring-charged drive is provided. However, for contactors, which open and close a circuit but are not required to break the circuit during overcurrent (e.g., short circuit) conditions, an electromagnetic operator is frequently utilized.

It will be appreciated that it is nonetheless desirable to provide a very rapid interruption of current, whereby the magnetic operator must release in a very short period of time. In order to accomplish this, a small air gap is frequently provided in the magnetic circuit in order to increase the reluctance of the circuit, even when it is closed, for instance by means of interposing a shim of nonmagnetic material, across the extending pole ends of a core to prevent intimate contact by a mating, magnetic armature piece.

Other ways of artificially increasing the reluctance of the magnetic path are known; for instance, by directing the magnetic path through an outer, non-magnetic frame; or by providing a laminated magnet core having a non-magnetic lamination which is riveted together with the other, magnetic laminations. Such a construction is shown, for example, in German Pat. No. 1,250,552.

While methods such as increasing magnetic reluctance by means of providing a non-magnetic lamination, or interposing a non-magnetic frame, have long been utilized, it is frequently difficult to provide the precise amount of increased reluctance needed to achieve the requisite magnetic properties which will allow for the rapid disengagement of the magnet armature.

It will therefore be understood that it would be highly desirable to provide a magnetic actuating system for a contactor which has readily reproduceable and highly predictable magnetic characteristics, without the need for interposing special laminations or frame figuration in the magnetic structure.

Accordingly, it is one object of the present invention to provide an improved magnetic operator for a circuit interrupter system.

Another object is to provide an electromagnetic operator which exhibits qualities associated with a structure having an air gap, but has no actual discontinuity of the core material.

Yet another object of the invention is to provide an improved core for a magnetic operator which is readily reproduced and manufactured.

SUMMARY OF THE INVENTION

Briefly stated, in accordance with the one aspect of the invention the foregoing objects are achieved by providing a fixed magnetic yoke in a general U-form, having a pair of extending legs and a transverse, back portion. One or more windings are placed upon the legs, and a movable armature disposed near the distal leg ends for being attracted thereto in the usual manner. The core is formed of solid (i.e., non-laminated) magnetic material. At a point intermediate the two magnetic legs, preferably near the midpoint of the back of the U-form, are a plurality of openings extending generally transverse to the locus of magnetic lines of flux. The size and number of openings determine the amount of magnetic material connecting the two sides of the U-form yoke, and therefore the flux density in the narrowed zones lying between the openings.

BRIEF DESCRIPTION OF THE DRAWING

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
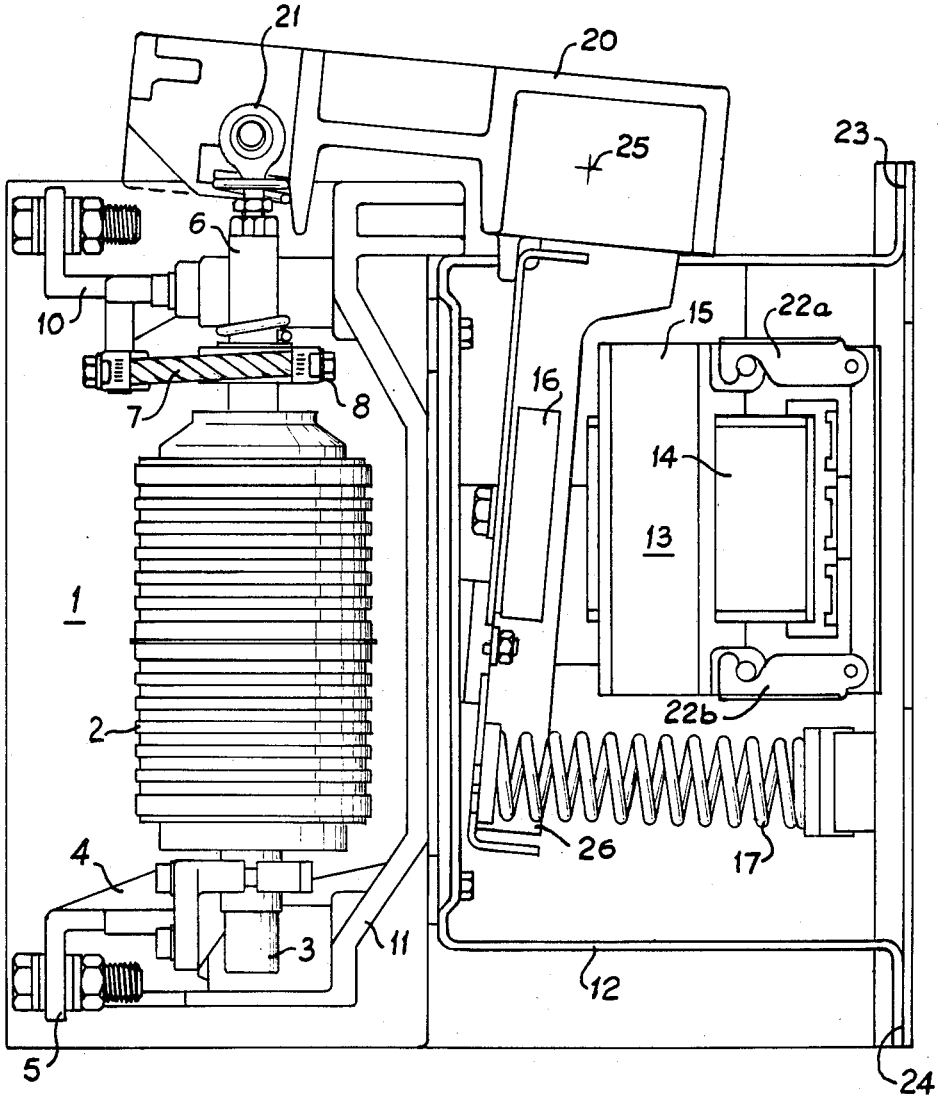
FIG. 1 is a side cutaway view of a circuit interrupter apparatus utlizing the invention.

Referring now to FIG. 1, an electrical contactor apparatus is shown, of the type utilizing a vacuum interrupter 2 of any one of the various types known to those skilled in the art. Such interrupters commonly comprise an outer housing, and within the housing a pair of opposed contacts. One of the contacts is movable with respect to the other, and may be moved by external means to either contact the other, in which case the circuit is closed, or to separate from the other in order to open the circuit. Since the contacts are maintained in a vacuum there is no medium present to sustain an arc, other than a small amount of plasma generated from the metal of the contacts upon localized heating due to an arc. Accordingly, such an interrupter is highly efficient.

A connection stud 3, which may be a metal bar connected to the fixed contact within the interrupter, is held by a clamp 4 to a terminal 5 which is in turn connected to a bus bar, cable or other conductor.

At the top of interrupter 2 is another connection stud 6, which is connected to the movable contact within the interrupter. Stud 6, which is allowed some limited movement by means of a metal bellows or other flexible seal, is slidingly supported in a stationary terminal means 10 which is also adapted to be afixed to a bus bar, cable or other conductor. A good electrical connection between the movable connection stud 6 and terminal 10 is provided by means of a flexible conductor 7, connected to stud 6 by a clamping means 8. The upper end of stud 6 is connected by arm 20 by means of a swivel connection 21. Arm 20 is pivoted upon axis 25 by means of a journal bolt or shaft (not shown).

Extending downwardly from arm 20 is an extension 26, which along with arm 20 and bar 16 forms the armature of the system to be described. Bar 16 is formed of a length of magnetic material for purposes hereinafter set forth.

A magnet generally indicated at 13 is mounted on housing 12 by appropriate means such as bolts or clamps (not shown). The rear portion of the housing advantageously comprises extensions 23, 24 which allow the same to be mounted against a suitable support. Magnet assembly 13 comprises a core 14 of a solid magnetic material and a winding 15 which is secured in place by latches *22a, 22b*. A compression spring 17 extends between the housing and arm 26 for urging the latter to the left, and therefore urging bar 16 away from the confronting ends of magnet core 14. This effects a clockwise rotation of arm 20 which in turn raises stud 6, opening the contacts within vacuum interrupter 2.

Figure 3:
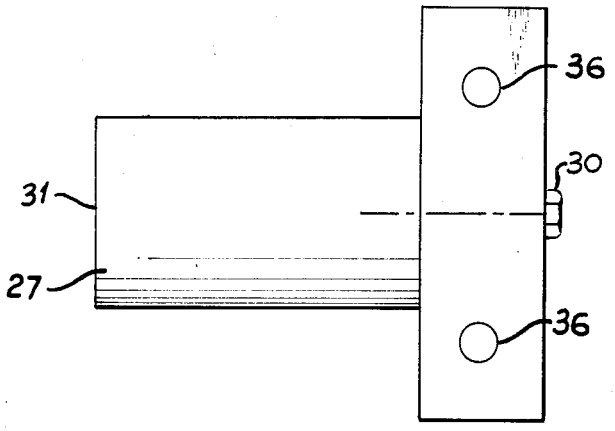
FIG. 3 is a side elevation of the core of FIG. 2.
Figure 4:
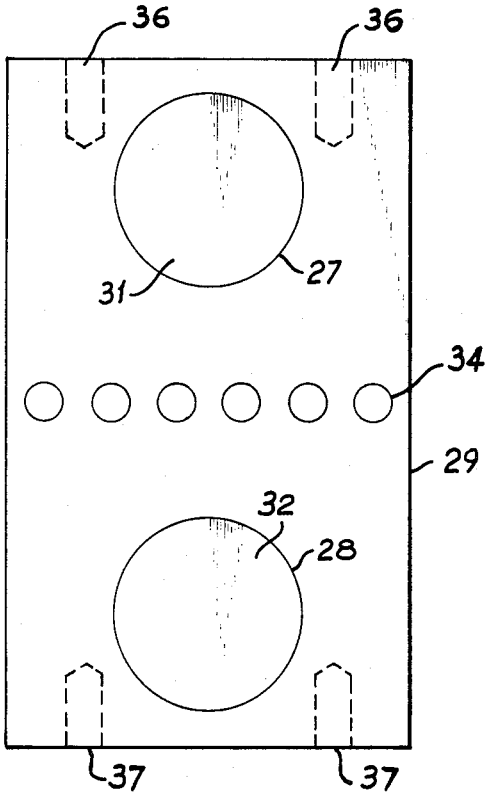
FIG. 4 is an end view of the core of FIG. 2.
Figure 2:
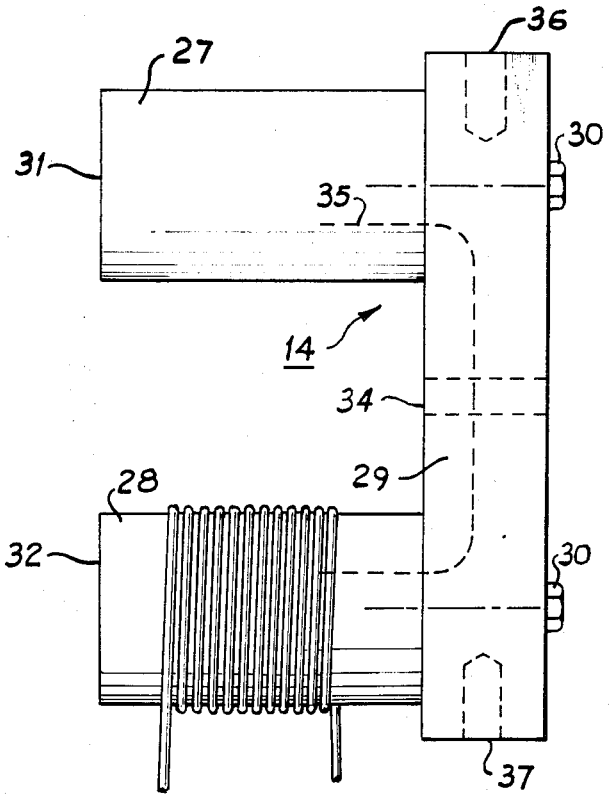
FIG. 2 is a plan view of a magnetic core according to the invention.

Referring to FIGS. 2, 3 and 4 it will be seen that core 4 of the magnet assembly is a generally U-shaped yoke comprising opposed legs 27 and 28 connected by a generally straight back member 29. The yoke is formed of solid magnetic material, in the form of preformed elements which are assembled together by appropriate means, here shown as capscrews 30. Bar 16 extends across confronting faces 31 and 32 of legs 27 and 28, respectively and one or more windings are disposed on the yoke legs for giving rise to a magnetic flux along the path generally indicated as 35.

From an inspection of the figures, it will now be apparent that as current is introduced into coil 15, magnetic flux arises in the U-shaped yoke, and extends between pole faces 31, 32 through bar 16. The magnetic forces thus given rise to attract bar 16 toward the ends of yoke legs 27 and 28, which in turn overcome the bias of spring 17 and cause arm 20 to rotate in a counterclockwise direction. This in turn forces terminal stud 6 downwardly until the contacts within vacuum interrupter 2 are urged tightly together, completing an electrical circuit between terminals 5 and 10 and allowing current to flow to the apparatus connected thereto.

When it is desired to interrupt the circuit current flow to winding 15 is discontinued, whereby the magnetic field previously set up collapses and the magnetic force drawing bar 16 against the faces of legs 27, 28 disappears. As this occurs spring 17 urges the armature to the left, separating the contacts within interrupter 2.

It will be appreciated by those skilled in the art that it is highly desirable to break an electrical circuit quickly and sharply so that no arcing will occur, which would be most detrimental to the circuit breaking apparatus. In order to accomplish this, it is desirable that bar 16 be disengaged from core 14 extremely rapidly. Further, should the power supply for winding 15 experience an undervoltage condition, leading to a less-than-normal current supply and effecting the weakening of the magnetic flux of the system, it is preferable that the resulting disengagement be rapid, and therefore that the magnetic forces decline sharply as the exciting current decreases. Further, under normal circumstances it is always desirable for the armature to be rapidly disengaged as current to the exciting winding 15 is cut off. Owing to the natural inductance of the electromagnet, current may not stop immediately, but will diminish according to well-understood laws of physics.

Despite this more gradual-than desired decline, it is still wished to cause the magnetic flux thus produced to decrease very rapidly.

In order to achieve the desired effect it is known to place an air gap in the magnetic circuit, or equivalently to interpose an element of non-magnetic material in the circuit. For instance, a non-magnetic shim may be disposed on one or both pole faces 31, 32. Alternatively, core 14 may be formed of laminations in a known manner, and one or more of the laminations made of a non-magnetic material so as to replicate the effect of an air gap in the stacked laminations, while allowing the laminations to be assembled in a solid pack. It is also known to form an armature such as bar 16 with openings there through or to interpose in the magnetic circuit a portion of the non-magnetic frame or support for the core, which also adds to the magnetic reluctance of the system. With such modifications of the magnetic circuit, the increased reluctance causes magnetic flux to diminish very rapidly as exciting current decreases, with the result that the armature of the system is quickly released even though exciting current may diminish more slowly. Unfortunately, providing air gaps or installing non-magnetic elements in a magnetic circuit are frequently expensive, and require additional manufacturing steps.

With the present invention, the problem is addressed by providing a number of openings 34 extending transversely to the direction of magnetic flux, as shown in FIG. 2. In a presently preferred embodiment holes 34 are bored transversely through the back or bridging member of the U-shaped yoke, generally parallel to the axes of legs 27, 28. As is more evident from FIG. 4, the cross section of magnetic material lying between the holes is considerably smaller than the magnetic cross section of other parts of the core, so that an area of high reluctance is introduced into the magnetic path of the yoke itself. The degree of reluctance may be controlled by varying the effective cross section of the yoke material, which in turn is easily varied by controlling the number and size of the holes to be drilled. Since the diameter and location of the holes can be precisely controlled, magnet yokes having substantially identical qualities may readily be manufactured. Further, the boring of such holes does not requires special or sophisticated tools or machinery, and therefore the invention can be practiced with commonly available equipment.

In the presently preferred embodiment a series of holes 36, 37 are bored partway into the edges of the yoke bridge for mounting purposes. Such holes may be tapped for receiving threaded bolts; or may be left blank, for locating dowels. Such modifications are clearly within the skill of the manufacturer of such items, and form no part of the present invention.

In the example illustrated the residual cross section of the back portion of the yoke lying between holes 34 amounts to about 50% of the total yoke cross section. The characteristics of the resulting magnet, however, are significantly better than those observed with an equivalent air gap in comparable magnets. In one successfully-tested embodiment, for example, addition of holes as shown decreased magnet operating time from 150 milliseconds to 40 milliseconds. Further, since a significant portion of the yoke cross section remains, the mechanical integrity of core 14 and the strength thereof is fully sufficient for present purposes. The magnetic core is particularly well suited to use with direct current as it is made of solid magnetic material, as opposed to laminations when, for instance, it is desired to interpose non-magnetic shims. Further, a diminished current requirement for coil 15, when the armature is in a closed position, as compared to the value required to move the armature, has been observed in practice.

It will now be seen that there has been discosed herein an improved construction for a magnetic core of the type used for actuating a circuit interrupter system. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and scope of the invention.

What is claimed as new and desired to be secured by Letters Patent of the United States is:

1. A magnetic yoke formed of a plurality of elements of solid magnetic material, comprising:

a pair of leg members;

a bridge member having magnetic flux lines;

means for connecting the leg members and the bridge member in a general U-form;

said bridging member having at least one opening extending through the midsection thereof, generally transverse thereto and generally transverse to the magnetic flux lines.

2. A magnetic yoke as defined in claim 1, having a plurality of generally parallel, aligned openings extending transverse to said bridge member, the plane of the aligned openings further being generally transverse to the bridge member.

3. A magnetic yoke according to claim 1, wherein each of said leg members is coupled to said bridge member by means of a threaded fastener.

4. An electromagnetic operator for a circuit interrupter or the like comprising:

generally U-shaped magnetic core means having magnetic reluctance;

at least one excitation coil disposed on a leg of the U-shaped core means;

armature means comprising a magnetic bar disposed adjacent the ends of said U-shaped core means and being atttracted towards said magnetic core in response to energization of said excitation coil and released therefrom in response to de-energization of said coil in a predetermined amount of time;

spring means for biasing said armature away from said U-shaped core means a plurality of openings extending transversely through said U-shaped core means at a point between the legs of said U-shaped core means; said openings increasing the magnetic reluctance of the core and decreasing the release time of the armature.

5. An operator according to claim 4, wherein said plurality of openings comprise circular holes extending transversely to the path of magnetic flux within said core means; said holes being aligned with one another in a plane also generally perpendicular to the direction of said flux.

6. An operator according to claim 5, wherein said holes extend in a direction generally parallel to the legs of said U-shaped core means.

7. An operator according to claim 6, wherein said u-shaped core means is formed of three blocks of solid magnetic material;

two blocks forming the opposed legs of said u-shaped core means and the third block forming a bridge member connecting the legs of said U-shaped core means; and connecting means for securing said legs to said bridge member.

* * * * *